US008826560B2

(12) United States Patent
Beach et al.

(10) Patent No.: US 8,826,560 B2
(45) Date of Patent: Sep. 9, 2014

(54) SUPPORT APPARATUS FOR SUPPORTING A SYPHON

(75) Inventors: Matthew H. Beach, Kalamazoo, MI (US); Alan T Ives, Marcellus, MI (US)

(73) Assignee: Kadant Inc., Three Rivers, MI (US)

( * ) Notice: Subject to any disclaimer, the term of this patent is extended or adjusted under 35 U.S.C. 154(b) by 1176 days.

(21) Appl. No.: 11/514,691

(22) Filed: Sep. 1, 2006

(65) Prior Publication Data

US 2008/0052946 A1 Mar. 6, 2008

(51) Int. Cl.
*F26B 25/00* (2006.01)

(52) U.S. Cl.
USPC ..... 34/124; 34/125; 34/119; 165/90; 277/306; 162/359.1

(58) Field of Classification Search
USPC ..... 34/117, 119, 124, 125; 165/90; 277/306; 162/385.5, 359.1
See application file for complete search history.

(56) References Cited

U.S. PATENT DOCUMENTS

| | | | | | |
|---|---|---|---|---|---|
| 216,245 | A | | 6/1879 | Warth | |
| 220,243 | A | * | 10/1879 | Jamison | 34/124 |
| 2,005,734 | A | * | 6/1935 | Field | 62/72 |
| 2,049,050 | A | * | 7/1936 | Cram | 34/119 |
| 2,056,562 | A | * | 10/1936 | Bridge | 285/18 |
| 2,150,132 | A | * | 3/1939 | Sandwell | 34/454 |
| 2,166,245 | A | | 7/1939 | Goff | |
| 2,367,578 | A | * | 1/1945 | Helin | 165/82 |
| 2,381,432 | A | * | 8/1945 | Bratton | 34/124 |
| 2,413,567 | A | * | 12/1946 | Hornbostel | 34/124 |
| 2,460,059 | A | * | 1/1949 | Bruker | 34/125 |
| 2,582,365 | A | * | 1/1952 | Westphal | 34/124 |
| 2,586,829 | A | * | 2/1952 | Kelsey | 34/124 |
| 2,617,205 | A | * | 11/1952 | Cram | 34/124 |
| 2,643,099 | A | * | 6/1953 | Kinraide et al. | 165/89 |
| 2,703,224 | A | * | 3/1955 | Robinson | 62/314 |
| 2,724,909 | A | * | 11/1955 | White et al. | 34/124 |
| 2,869,248 | A | * | 1/1959 | Justus | 34/568 |
| 2,875,527 | A | * | 3/1959 | Daane | 34/124 |
| 2,879,039 | A | * | 3/1959 | Skinner | 165/89 |
| 2,885,790 | A | * | 5/1959 | Cram | 34/552 |
| 2,887,786 | A | * | 5/1959 | Cocker, III | 34/87 |
| 2,932,091 | A | * | 4/1960 | Day | 34/124 |
| 2,978,815 | A | * | 4/1961 | Hieronymus | 34/125 |
| 2,993,282 | A | * | 7/1961 | Daane et al. | 34/125 |

(Continued)

FOREIGN PATENT DOCUMENTS

| | | | | |
|---|---|---|---|---|
| DE | 3142701 | A1 * | 5/1983 | B05C 1/08 |
| DE | 4110709 | A1 * | 10/1992 | D21F 5/02 |
| GB | 2242917 | A * | 10/1991 | E03D 1/08 |

*Primary Examiner* — Steve M Gravini
(74) *Attorney, Agent, or Firm* — David J. Archer

(57) ABSTRACT

A support apparatus and method is disclosed for supporting a syphon within a rotating cylinder. The apparatus includes a hub which is disposed within the rotating cylinder. The hub has a first and a second end, the hub defining a bore which extends between the ends of the hub for rotatably supporting the syphon. A first, second and third arm extend from the hub, each of the arms extending radially outwardly from the hub. Each of the arms has an inner and an outer extremity. The inner extremities of the arms are disposed adjacent to the hub. Also, the outer extremities of the arms are disposed adjacent to an internal surface of the rotating cylinder such that the arms and the hub support the syphon within the rotating cylinder while permitting rotation of the rotating cylinder relative to the syphon.

17 Claims, 5 Drawing Sheets

(56) References Cited

U.S. PATENT DOCUMENTS

| | | | | | |
|---|---|---|---|---|---|
| 3,009,261 | A | * | 11/1961 | Hieronymus | 34/125 |
| 3,034,225 | A | * | 5/1962 | Hieronymus | 34/125 |
| 3,217,426 | A | * | 11/1965 | Barnscheidt et al. | 34/110 |
| 3,241,251 | A | * | 3/1966 | Justus et al. | 34/124 |
| 3,242,583 | A | * | 3/1966 | Calkins | 34/422 |
| 3,248,967 | A | * | 5/1966 | Lewis | 74/573.11 |
| 3,251,138 | A | * | 5/1966 | Whittaker | 34/552 |
| 3,308,554 | A | * | 3/1967 | Overton | 34/124 |
| 3,325,910 | A | * | 6/1967 | Toivonen | 34/124 |
| 3,368,288 | A | * | 2/1968 | Bell | 34/125 |
| 3,498,591 | A | * | 3/1970 | Calkins | 165/89 |
| 3,601,902 | A | * | 8/1971 | Schiel | 34/124 |
| 3,614,983 | A | * | 10/1971 | Calkins | 165/89 |
| 3,633,662 | A | * | 1/1972 | Voll | 165/89 |
| 3,721,016 | A | * | 3/1973 | Lee et al. | 34/125 |
| 3,943,638 | A | * | 3/1976 | Robson | 34/124 |
| 3,948,283 | A | * | 4/1976 | Asfura et al. | 137/152 |
| 3,967,386 | A | * | 7/1976 | Asfura | 34/124 |
| 4,081,913 | A | * | 4/1978 | Salminen | 34/454 |
| 4,183,149 | A | * | 1/1980 | Chance et al. | 34/454 |
| 4,184,268 | A | * | 1/1980 | Christin et al. | 34/124 |
| 4,205,457 | A | * | 6/1980 | Sjostrand | 34/524 |
| 4,222,178 | A | * | 9/1980 | Moran | 34/445 |
| 4,253,245 | A | * | 3/1981 | Perrault | 34/552 |
| 4,357,758 | A | * | 11/1982 | Lampinen | 34/331 |
| 4,359,829 | A | | 11/1982 | Schiel | |
| 4,369,586 | A | | 1/1983 | Wedel | |
| 4,384,412 | A | | 5/1983 | Chance | |
| 4,447,964 | A | * | 5/1984 | Gardner | 34/452 |
| 4,489,249 | A | * | 12/1984 | Olivier | 310/216 |
| 4,493,158 | A | * | 1/1985 | van Os | 34/454 |
| 4,498,249 | A | * | 2/1985 | Cooke et al. | 34/125 |
| 4,499,668 | A | * | 2/1985 | Jumpeter | 34/454 |
| 4,501,075 | A | * | 2/1985 | Jenkner et al. | 34/125 |
| 4,516,334 | A | * | 5/1985 | Wanke | 34/124 |
| 4,538,360 | A | | 9/1985 | Chance | |
| 4,590,688 | A | | 5/1986 | Steffero, Sr. | |
| 4,606,136 | A | | 8/1986 | Pflug | |
| 4,606,560 | A | | 8/1986 | McCracken | |
| 4,674,196 | A | * | 6/1987 | Means | 34/454 |
| 4,691,452 | A | | 9/1987 | Ferguson | |
| 4,716,661 | A | * | 1/1988 | Asman | 34/125 |
| 4,718,177 | A | * | 1/1988 | Haeszner et al. | 34/119 |
| 4,738,752 | A | * | 4/1988 | Busker et al. | 162/358.5 |
| 4,870,462 | A | * | 9/1989 | Day | 399/249 |
| 4,924,603 | A | * | 5/1990 | Wolf | 34/125 |
| 4,965,920 | A | * | 10/1990 | Smith | 19/258 |
| 5,020,243 | A | * | 6/1991 | Miller et al. | 34/119 |
| 5,024,266 | A | * | 6/1991 | Critchlow | 165/89 |
| 5,109,612 | A | * | 5/1992 | Timm | 34/119 |
| 5,230,169 | A | * | 7/1993 | Jaatinen et al. | 34/124 |
| 5,335,427 | A | * | 8/1994 | Partio | 34/119 |
| 5,359,781 | A | | 11/1994 | Melville | |
| 5,416,980 | A | * | 5/1995 | Ilvespaa | 34/117 |
| 5,524,355 | A | * | 6/1996 | Schiel et al. | 34/119 |
| 5,528,838 | A | * | 6/1996 | Timm et al. | 34/124 |
| 5,533,569 | A | * | 7/1996 | Reibel et al. | 165/90 |
| 5,548,901 | A | | 8/1996 | Isler | |
| 5,829,158 | A | * | 11/1998 | Straub et al. | 34/121 |
| 5,864,963 | A | * | 2/1999 | Komulainen | 34/124 |
| 5,878,507 | A | * | 3/1999 | Schiel et al. | 34/119 |
| 5,901,462 | A | * | 5/1999 | Rudd | 34/274 |
| 5,907,909 | A | * | 6/1999 | Autio | 34/125 |
| 5,921,000 | A | * | 7/1999 | Wedel et al. | 34/117 |
| 5,933,977 | A | * | 8/1999 | Deshpande et al. | 34/116 |
| 5,933,980 | A | * | 8/1999 | Deshpande et al. | 34/446 |
| 5,941,170 | A | * | 8/1999 | Davis et al. | 100/328 |
| 5,943,788 | A | * | 8/1999 | Autio | 34/119 |
| 6,128,827 | A | * | 10/2000 | Hendrix | 34/121 |
| 6,151,797 | A | * | 11/2000 | Fleissner | 34/115 |
| 6,158,501 | A | * | 12/2000 | Koivukunnas | 165/89 |
| 6,161,302 | A | * | 12/2000 | Rantala | 34/119 |
| 6,161,303 | A | * | 12/2000 | Beck | 34/119 |
| 6,185,836 | B1 | * | 2/2001 | Zaoralek | 34/119 |
| 6,203,072 | B1 | * | 3/2001 | Berghuis et al. | 285/24 |
| 6,227,545 | B1 | * | 5/2001 | Kugler | 277/306 |
| 6,379,502 | B1 | * | 4/2002 | Satzger et al. | 162/193 |
| 6,416,631 | B1 | * | 7/2002 | Beck | 162/360.3 |
| 6,487,789 | B1 | * | 12/2002 | Wolf et al. | 34/114 |
| 6,701,637 | B2 | * | 3/2004 | Lindsay et al. | 34/71 |
| 6,773,786 | B1 | * | 8/2004 | Kuckart | 428/141 |
| 6,860,970 | B2 | * | 3/2005 | Ampulski | 162/359.1 |
| 6,896,771 | B2 | * | 5/2005 | Best et al. | 162/358.2 |
| 6,938,435 | B2 | * | 9/2005 | Goseling et al. | 62/342 |
| 7,005,043 | B2 | * | 2/2006 | Toney et al. | 162/361 |
| 7,018,513 | B2 | * | 3/2006 | Smith | 162/375 |
| 7,022,208 | B2 | * | 4/2006 | Davenport et al. | 162/358.2 |
| 7,028,756 | B2 | * | 4/2006 | Ives et al. | 165/89 |
| 7,422,661 | B2 | * | 9/2008 | Ahvenniemi et al. | 162/289 |
| 7,473,335 | B2 | * | 1/2009 | Wanke et al. | 162/198 |
| 7,510,631 | B2 | * | 3/2009 | Scherb et al. | 162/358.1 |
| 7,524,403 | B2 | * | 4/2009 | Fernandes et al. | 162/358.4 |
| 7,527,709 | B2 | * | 5/2009 | Lippi Alves Fernandes et al. | 162/358.4 |
| 7,550,061 | B2 | * | 6/2009 | Walkenhaus et al. | 162/358.1 |
| 7,673,395 | B2 | * | 3/2010 | Timm et al. | 34/125 |
| 7,686,923 | B2 | * | 3/2010 | Scherb et al. | 162/358.1 |
| 2002/0152630 | A1 | * | 10/2002 | Lindsay et al. | 34/111 |
| 2003/0075293 | A1 | * | 4/2003 | Moeller et al. | 162/193 |
| 2004/0159003 | A1 | * | 8/2004 | Kolb et al. | 34/114 |
| 2005/0016915 | A1 | * | 1/2005 | Beck | 210/490 |
| 2006/0070713 | A1 | * | 4/2006 | Wanke et al. | 162/198 |
| 2006/0085999 | A1 | * | 4/2006 | Scherb et al. | 34/453 |
| 2006/0169734 | A1 | * | 8/2006 | Ahvenniemi et al. | 226/92 |
| 2006/0179677 | A1 | * | 8/2006 | Timm et al. | 34/110 |
| 2007/0175605 | A1 | * | 8/2007 | Shakespeare et al. | 162/197 |
| 2008/0052946 | A1 | * | 3/2008 | Beach et al. | 34/239 |

* cited by examiner

SUPPORT APPARATUS FOR SUPPORTING A SYPHON

BACKGROUND OF THE INVENTION

1. Field of the Invention

The present invention relates to a support apparatus for supporting a syphon.

More specifically, the present invention relates to a support apparatus and method for supporting a stationary syphon within a rotating cylinder.

2. Background Information

The present invention provides a method and apparatus for heating a roll, the apparatus using a stationary syphon fluid passage which extends from the inside surface of a rotating cylinder roll to a rotary joint connected to external stationary piping. The invention more specifically provides for a rotating internal support for the stationary syphon, the support being adjustable so as to position and hold the stationary syphon on the rotational axis of the rotating cylinder roll, so that the stationary internal flow passage of the stationary syphon can remove condensed steam, heat transfer fluid or cooling water from the inside surface of the rotating cylinder. The rotating syphon support is mounted to the inside surface of the rotating cylinder and it supports the syphon pipe through renewable bushings.

The rotating cylinder is used to dry paper, foodstuffs, textiles, and the like, as they pass over the outside surface of the rotating cylinder. Alternatively, the rotating cylinder is used to heat or cool similar products as they pass over the outside surface of the rotating cylinder.

Conventional stationary syphons are either cantilevered from the external rotary joint or supported by brackets that are either bolted to the dryer journal or to the inside surface of the dryer head. These prior art arrangements require the dryer journal to have a large diameter bore or the dryer head to have a machined surface on the inside for bolting the bracket to the head.

However, many older dryers have small journal bores and no inside cylinder head machining. This situation often prevents such dryers from being upgraded to stationary syphons. In the present invention, the stationary syphon pipe can be supported inside the dryer by a carbon graphite bushing that is mounted on a bracket that is, in turn, supported through a tripod mounting to the inside dryer surface. The arrangement according to the present invention allows upgrading dryers to stationary syphons for increased production at a lower cost than replacing the dryer so that traditional stationary syphons are able to be used.

Wet paper webs are dried by a series of metal rolls in the paper making process. These rolls are heated by steam that passes through a rotary joint, through the roll journal, and into the inside of the metal roll. The steam is supplied to the rotary joint from piping that is fixed or stationary. The steam then goes through the journal of the roll. Once inside the roll, the steam condenses as the heat from the steam is transferred to the inside surface of the roll. The condensed steam, which is water or "condensate" must then be removed so that the roll does not fill up with water. The water is removed through a pipe called a "syphon". The condensate flows into the syphon pipe, up to the enter axis of the roll and then out the roll through the syphon pipe that extends through the roll journal. Syphons either turn with the roll ("rotary" syphons) or remain fixed with the joint ("stationary" syphons).

Stationary syphons that are used to remove condensate are attached to a stationary portion of the rotary joint in order to prevent rotation of the syphon and to seal the inlet flow of steam from the outlet flow of condensate and blow through steam. Conventional stationary syphons are mounted in one of three ways. The most popular method is to use a large cantilevered support tube mounted in the rotary joint. The tube extends through the dryer journal and into the dryer roll. The cantilever tube supports the syphon pipe that extends from the dryer axis to the dryer shell. The tube is generally stiffer and stronger than standard pipe to support the weight and other forces.

The second method of supporting the stationary syphon is to use a large cantilevered support tube that is mounted to the outside end of the journal. The rotary joint can be mounted either to the end of the dryer journal or to an external support. In this configuration, the condensate pipe is attached to a stationary portion of the rotary joint and extends through the support tube to the inside of the dryer cylinder. The tube supports the stationary syphon pipe on the inboard end of the support tube, inside the cylinder. The support tube is larger in diameter, stiffer, and stronger than the condensate pipe and is therefore capable of supporting the syphon weight and associated loading.

The third method of supporting the stationary syphon is a bracket support that is mounted inside the roll where the journal bore terminates inside the roll. The rotary joint can be mounted either to the end of the dryer journal or to an external support. In this configuration, the condensate pipe is attached to a stationary portion of the rotary joint and extends through the journal to the inside of the dryer cylinder. The bracket supports the condensate pipe at the end that is located inside the dryer. The bracket is mounted close to the inboard end of the pipe to give it proper support. The bracket spins with the roll while the condensate pipe remains stationary (that is, not rotating). Carbon graphite or equivalent bushings are used in the bracket to allow relative motion between the bracket and the condensate pipe. The bracket is stiffer and stronger than the condensate pipe and carries the weight and forces on the stationary syphon pipe.

The aforementioned prior art arrangements are limited to rolls that have internal machining or large journal bores. New paper machines are often designed for stationary syphon systems. Older machines, however, were often designed for rotary syphons that mounted to the inside surface of the roll shell and could be used with small journal bores. Consequently, older machines often have small journal bores without internal machining to allow the use of an internal support bracket.

Advances in syphon design and machine speed make stationary syphons the preferred equipment on many older machines. Stationary syphons cannot be used, however, because of the problems that arise in installing them in these older paper machine dryers.

To make it possible to mount stationary syphons in older paper machine rolls, the method and apparatus of the present invention can be used to support a stationary syphon pipe inside the dryer cylinder without the need for internal machining of the dryer head or large diameter journal bores. In the mounting arrangements of the present invention, the support is provided through a bushing that is held on the centerline of the roll axis and supported by a bracket and tripod system that extends outwardly to the inside surface of the dryer roll. The bushing allows the bracket to rotate relative to the stationary syphon pipe. This support system further includes the ability to locate the bushing along the roll journal axis, even if the inside roll surface is not concentric with the journal bore, as may be the case in older machine rolls.

In the concept of the present invention, the bushings for the condensate pipe are mounted in a center hub. The hub is supported by three length adjustable legs, arms or spoke assemblies. At the end of each spoke assembly is a plate or foot that contacts the inside or internal surface of the roll shell. In a preferred embodiment of the present invention, two of the spoke assemblies are rigid after adjustments are made. The end of the third spoke assembly is able to move along the spoke axis while staying in contact with both the hub and the shell of the dryer. The ability to move is necessary to apply and maintain a force to the shell, in order to provide a robust mounting. The force is generated by a spring mounted on the third spoke. This spring keeps the support assembly in place during operation.

The concept of the present invention is different from the prior art because it enables the mounting and centering of the stationary syphon in any roll regardless of the date of construction of such dryer roll. The concept is an improvement over the prior art arrangements because it serves a segment of the commercial market that the prior art designs cannot.

The arrangement according to the present invention would have particular application to dryers having an inside diameter of between 44.8" to 46.8". However, the present invention is not limited in any way to dryers having the aforementioned diameters.

Therefore, the primary feature of the present invention is the provision of a support apparatus for supporting a syphon within a rotating cylinder that overcomes the problems associated with the prior art machines and which makes a significant contribution to the papermaking art.

Another feature of the present invention is the provision of a support apparatus for supporting a syphon within a rotating cylinder that permits a retrofit to any type of drying, heating or cooling cylinder.

Other features and advantages of the present invention will be readily apparent to those skilled in the art by a consideration of the detailed description of a preferred embodiment of the present invention contained herein.

SUMMARY OF THE INVENTION

The present invention relates to a support apparatus for supporting a syphon within a rotating cylinder. The apparatus includes a hub which is disposed within the rotating cylinder. The hub has a first and a second end, the hub defining a bore which extends between the ends of the hub for rotatably supporting the syphon. A first, second and third arm extend from the hub, each of the arms extending radially outwardly from the hub. Each of the arms has an inner and an outer extremity. The inner extremities of the arms are disposed adjacent to the hub. Also, the outer extremities of the arms are disposed adjacent to an internal surface of the rotating cylinder such that the arms and the hub support the syphon within the rotating cylinder while permitting rotation of the rotating cylinder relative to the syphon.

In a more specific embodiment of the present invention, the hub is of cylindrical configuration. The hub has a first face which is disposed adjacent to the first end of the hub. Also, a second face is disposed adjacent to the second end of the hub. An external cylindrical surface extends from the first to the second face.

Moreover, the first and the second face are disposed normal to an axis of rotation of the hub and the bore extends from the first to the second face.

Additionally, the bore is disposed coaxially within the hub and the apparatus further includes a bearing which is disposed coaxially within the bore for bearingly supporting the hub relative to the syphon.

Each of the arms includes a first portion which has an inner end and an outer end, the inner ends of the first portions of the arms being secured to the hub.

A second portion has an inner termination and an outer termination, the inner terminations of the second portions of the arms are secured to the outer ends of the first portions of the arms. Also, the outer terminations of the second portions of the arms are secured to the internal surface of the rotating cylinder.

Each of the outer ends of the arms define a flange and each of the inner terminations of the second portions of the arms define a further flange. The arrangement is such that the further flange and the flange of each arm cooperate with each other for permitting the releasable fastening of the first and second portions to each other.

Moreover, each of the second portions include a first tube which has a first and a second side. A second tube has an inner and an outer side, the second tube slidably cooperating with the first tube.

A threaded device is provided for selectively adjusting an axial disposition of the tubes of the second portion relative to each other such that the arms and the hub disposed therebetween support the syphon relative to the internal surface of the rotating cylinder during rotation of the rotating cylinder around the syphon.

In a preferred embodiment of the present invention, the first tube slides telescopically within the second tube.

The second side of the first tube defines an external thread which cooperates with the threaded device. The arrangement is such that when the threaded device threadably engages the external thread of the first tube, the threaded device urges the inner side of the second tube axially relative to the first tube and radially relative to the hub for urging the outer side of the second tube against the internal surface of the rotating cylinder.

Additionally, the apparatus further includes a foot which is disposed between the outer side of the second tube and the internal surface of the rotating cylinder. The components are arranged such that the arms are firmly supported within the rotating cylinder for supporting the hub so that the syphon is supported by the hub and is stationary relative to the rotating cylinder.

More specifically, the apparatus further includes a biasing device which extends between the threaded device and the foot for evenly urging the foot into engagement with the internal surface of the rotating cylinder.

The biasing device in a preferred embodiment of the present invention is a compression spring which has an inner and an outer termination. The inner termination of the spring is biased against the threaded device and the outer termination of the spring is biased against the foot.

The present invention also includes a method of supporting a syphon within a rotating cylinder. The method includes the steps of supporting a hub which defines a bore within the rotating cylinder. The hub is supported by a plurality of arms which extend radially outwardly between the hub and the rotating cylinder.

The method also includes the steps of supporting the syphon such that the syphon extends through the bore for permitting rotation of the hub relative to the syphon and directing a laser beam through a journal of the rotating cylinder, the beam 100 being directed along an axis of rotation of the cylinder and along the bore.

The method steps include adjusting a relative length of the arms for positioning the hub within the cylinder and using the laser beam to guide the positioning of the hub so that the hub is positioned coaxially relative the rotational axis of the rotating cylinder.

In another embodiment of the present invention, the method of supporting a syphon within a rotating cylinder includes the steps of supporting a hub which defines a bore within the rotating cylinder, the hub being supported by a plurality of arms which extend radially outwardly between the hub and the rotating cylinder.

The method also includes supporting the syphon such that the syphon extends through the bore for permitting rotation of the hub relative to the syphon and piloting a centering gauge disposed on the bore of the hub. The centering gauge has a measurement arm that extends radially towards an internal surface of the rotating cylinder.

Additionally, the method includes adjusting a relative length of the arms respectively for positioning the hub within the cylinder and using the measurement arm to guide the positioning of the hub so that the hub is positioned coaxially relative a rotational axis of the rotating cylinder so that the stationary syphon is supported by the hub which is disposed coaxially within the rotating cylinder.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
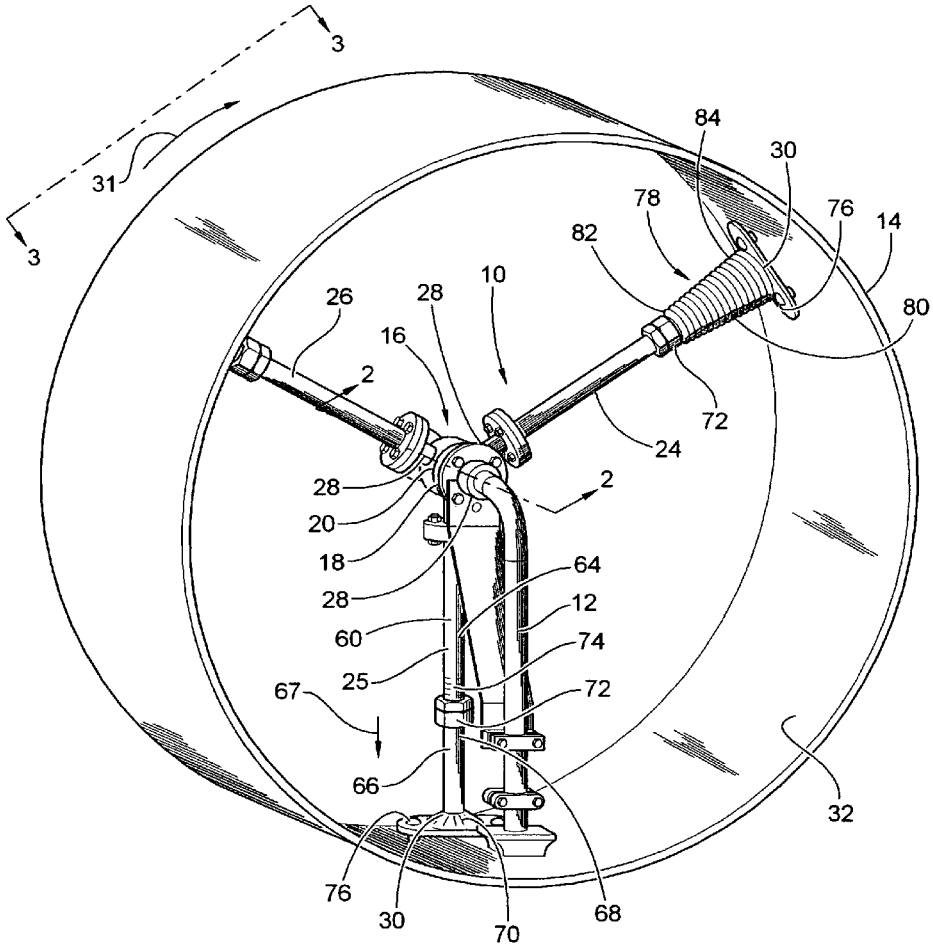
FIG. 1 is a perspective view of a support apparatus according to the present invention.

FIG. 1 is a perspective view of a support apparatus generally designated 10 according to the present invention. As shown in FIG. 1, the support apparatus 10 is provided for supporting a syphon 12 within a rotating cylinder 14. The apparatus 10 includes a hub generally designated 16 which is disposed within the rotating cylinder 14. The hub 16 has a first and a second end 18 and 20 respectively.

Figure 2:
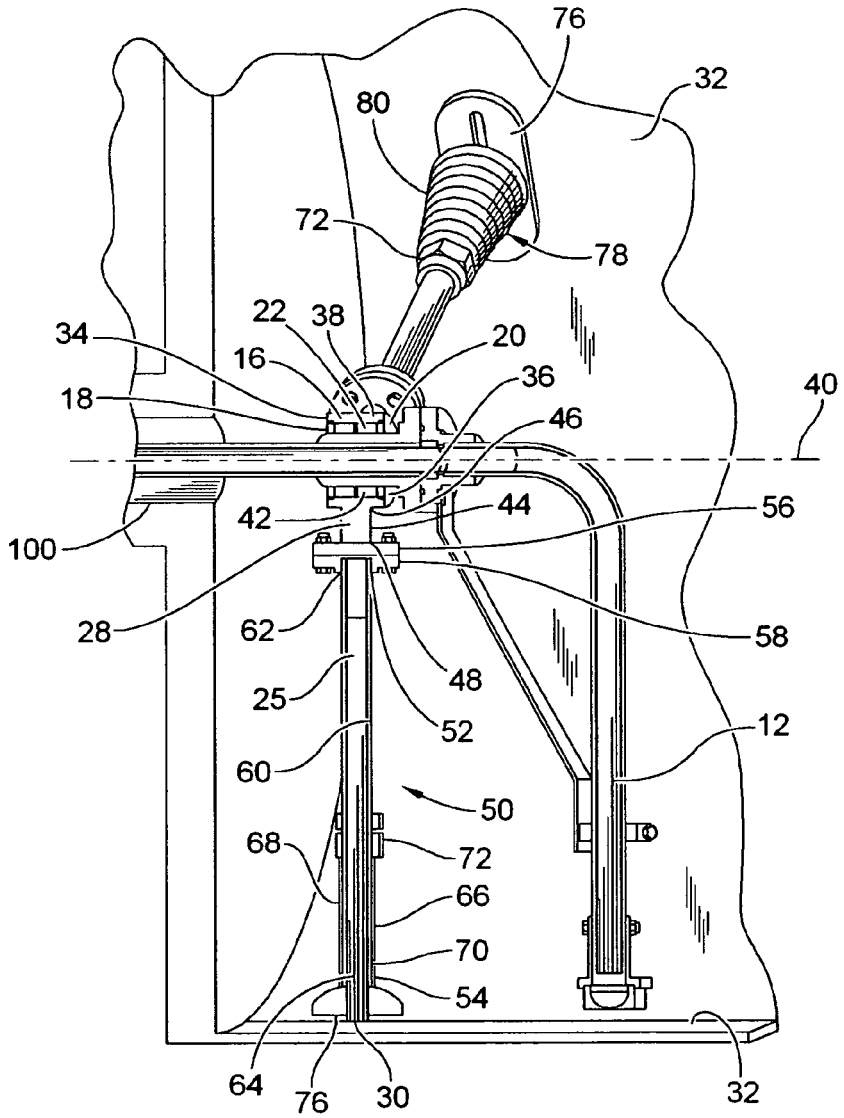
FIG. 2 is sectional view taken on the line 2-2 of FIG. 1.

FIG. 2 is sectional view taken on the line 2-2 of FIG. 1. As shown in FIG. 2, the hub 16 defines a bore 22 which extends between the ends 18 and 20 of the hub 16 for rotatably supporting the syphon 12.

As shown in FIG. 1, a first, second and third arm 24, 25 and 26 respectively extend from the hub 16, each of the arms 24-26 extending radially outwardly from the hub 16. Each of the arms 24-26 has an inner and an outer extremity 28 and 30 respectively. The inner extremities 28 of the arms 24-26 are disposed adjacent to the hub 16. Also, the outer extremities 30 of the arms 24-26 are disposed adjacent to an internal surface 32 of the rotating cylinder 14 such that the arms 24-26 and the hub 16 support the syphon 12 within the rotating cylinder 14 while permitting rotation as indicated by the arrow 31 of the rotating cylinder 14 relative to the stationary syphon 12.

As shown in FIG. 2, in a more specific embodiment of the present invention, the hub 16 is of cylindrical configuration. The hub 16 has a first face 34 which is disposed adjacent to the first end 18 of the hub 16. A second face 36 is disposed adjacent to the second end 20 of the hub 16. Also, an external cylindrical surface 38 of the hub 16 extends from the first face 34 to the second face 36.

Moreover, the first and the second face 34 and 36 respectively are disposed normal to an axis of rotation 40 of the hub 16.

Furthermore, the bore 22 extends from the first face 34 to the second face 36 and the bore 22 is disposed coaxially within the hub 16 relative to the axis of rotation 40.

Also, the apparatus 10 further includes a bearing 42 which is disposed coaxially within the bore 22 for bearingly supporting the hub 16 relative to the syphon 12.

Each of the arms 24-26 such as arm 25 includes a first portion 44 which has an inner end 46 and an outer end 48. The inner ends 46 of the first portions 44 of the arms 24-26 are secured to the hub 16. Also, each arm is preferably circumferentially equidistantly spaced from an adjacent arm.

Each of the arms 24-26 also include a second portion generally designated 50. The second portion 50 has an inner termination 52 and an outer termination 54. The inner termination 52 of the second portion 50 of the arm 25 is secured to the outer end 48 of the first portion 44 of the arm 25. Also, the outer termination 54 of the second portion 50 of the arm 25 is secured to the internal surface 32 of the rotating cylinder 14.

The outer end 48 of the first portion 44 of the arm 25 defines a flange 56 and the inner termination 52 of the second portion 50 of the arm 25 defines a further flange 58. The arrangement is such that the further flange 58 and the flange 56 of each arm 24-26 cooperate with each other for permitting the releasable fastening of the first portion 44 and second portions 50 to each other.

Moreover, the second portion 50 includes a first tube 60 which has a first and a second side 62 and 64 respectively. A second tube 66 has an inner and an outer side 68 and 70 respectively, the second tube 66 slidably cooperating with the first tube 60.

A threaded device 72 is provided for selectively adjusting an axial disposition of the tubes 60 and 66 respectively of the second portion 50 relative to each other such that the arms 24-26 and the hub 16 disposed therebetween support the syphon 12 relative to the internal surface 32 of the rotating cylinder 14 during rotation of the rotating cylinder around the syphon 12.

In a preferred embodiment of the present invention as shown in FIG. 2, the first tube 60 slides telescopically within the second tube 66.

As shown in FIG. 1, the second side 64 of the first tube 60 defines an external thread 74 which cooperates with the threaded device 72. The arrangement is such that when the threaded device 72 threadably engages the external thread 74 of the first tube 60, the threaded device 72 urges the inner side 68 of the second tube 66 axially relative to the first tube 60 and radially relative to the hub 16 as indicated by the arrow 67 for urging the outer side 70 of the second tube 66 against the internal surface 32 of the rotating cylinder 14.

Additionally, as shown in FIGS. 1 and 2, each arm of the arms 24-26 such as arm 25 includes a foot 76 which is disposed between the outer side 70 of the second tube 66 and the internal surface 32 of the rotating cylinder 14. The components are arranged such that the arms 24-26 are firmly supported within the rotating cylinder 14 for supporting the hub 16 so that the syphon 12 is held stationary relative to the rotating cylinder 14.

As shown in FIGS. 1 and 2, the apparatus 10 further includes a biasing device generally designated 78 which extends between the threaded device 72 of the arm 24 and the foot 76 for evenly urging the foot 76 into engagement with the internal surface 32 of the rotating cylinder 14.

As shown in FIGS. 1 and 2, the biasing device 78 is a compression spring 80 which has an inner and an outer termination 82 and 84 respectively. The inner termination 82 of the spring 80 is biased against the threaded device 72 and the outer termination 84 of the spring 80 is biased against the foot 76.

Figure 3:
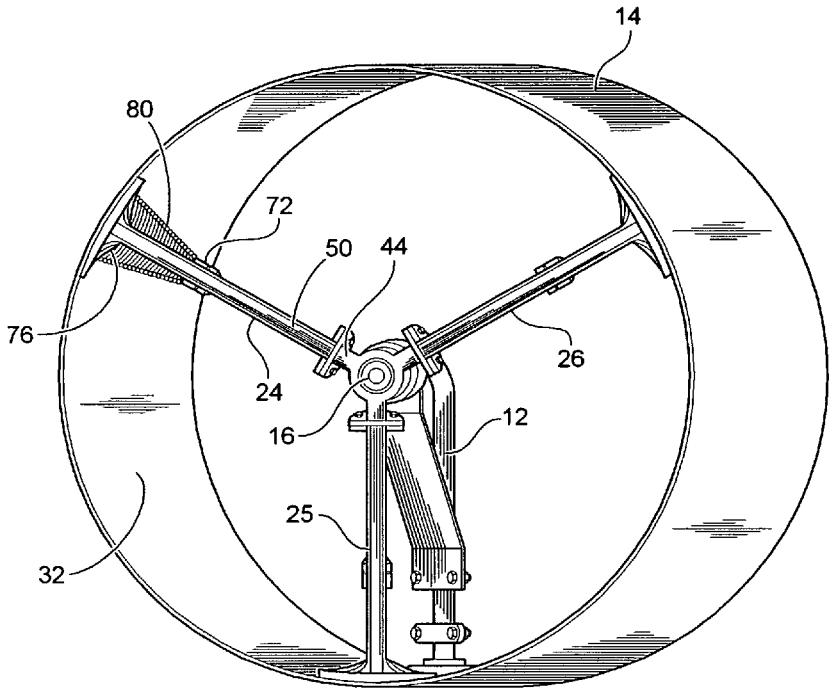
FIG. 3 is a further perspective view of the support apparatus viewed on the line 3-3 shown in FIG. 1.

FIG. 3 is a further perspective view of the apparatus 10 viewed on the line 3-3 shown in FIG. 1. As shown in FIG. 3, the first arm 24 is the only arm that includes a compression spring 80.

Figure 4:
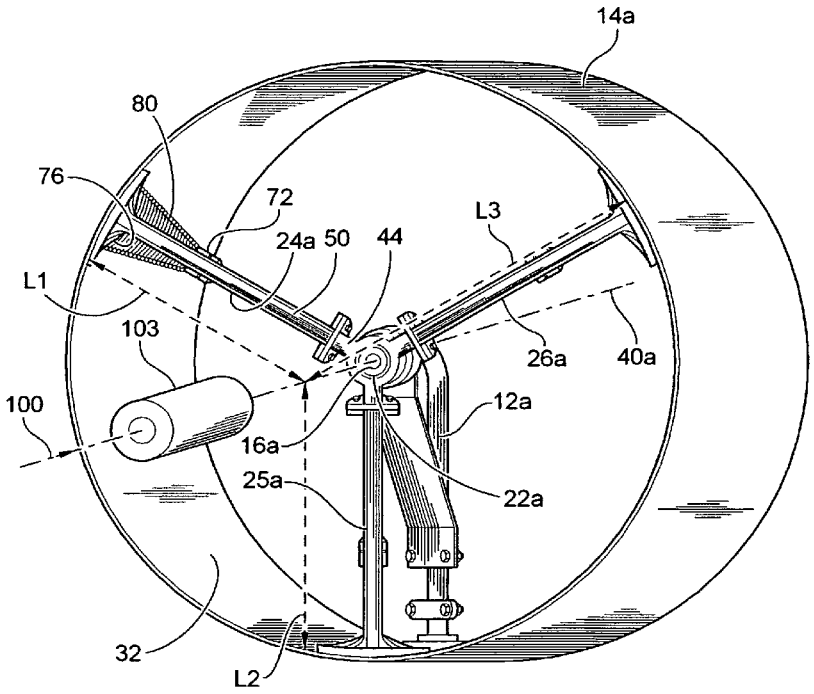
FIG. 4 is a perspective view similar to that shown in FIG. 3 but shows a further embodiment of the present invention.

FIG. 4 is a perspective view similar to that shown in FIG. 3 but shows a further embodiment of the present invention. As shown in FIG. 4, the method includes supporting a syphon 12*a* within a rotating cylinder 14*a*. The method includes the steps of supporting a hub 16*a* which defines a bore 22*a* within the rotating cylinder 14*a*. The hub 16*a* is supported by a plurality of arms 24*a*, 25*a* and 26*a* which extend radially outwardly between the hub 16*a* and the rotating cylinder 14*a*.

The method also includes the steps of supporting the syphon 12*a* such that the syphon 12*a* extends through the bore 22*a* for permitting rotation of the hub 16*a* relative to the syphon 12*a* and directing a laser beam 100 through a journal 103 of the rotating cylinder 14*a*, the beam 100 being directed along an axis of rotation 40*a* of the cylinder 14*a* and along the bore 22*a*.

The method steps include adjusting a relative length L1, L2 and L3 of the arms 24*a*-26*a* respectively for positioning the hub 16*a* within the cylinder 14*a* and using the laser beam 100 to guide the positioning of the hub 16*a* so that the hub 16*a* is positioned coaxially relative the rotational axis 40*a* of the rotating cylinder 14*a*.

Figure 5:
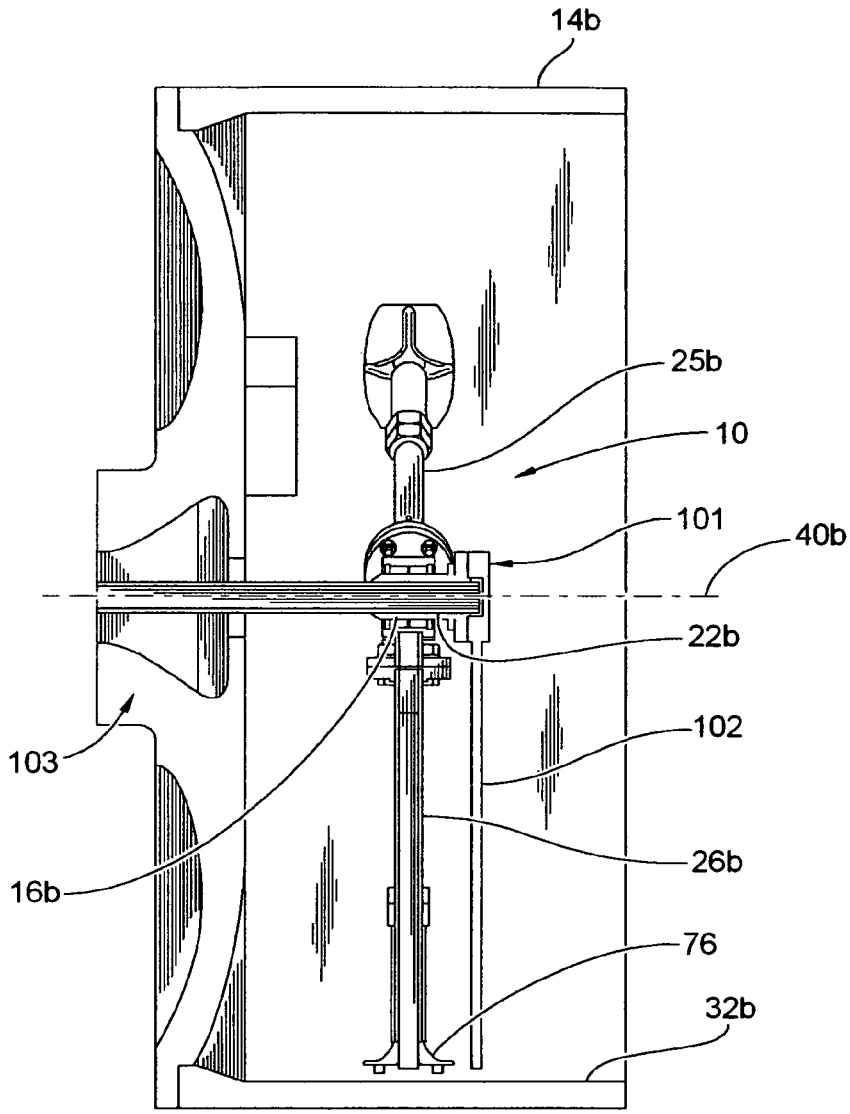
FIG. 5 is a sectional view of yet another embodiment of the present invention.

FIG. 5 is a sectional view of yet another embodiment of the present invention. As shown in FIG. 5, the method of supporting a syphon 12 (partially shown) within a rotating cylinder 14*b* includes the steps of supporting a hub 16*b* which defines a bore 22*b* within the rotating cylinder 14*b*, the hub 16*b* being supported by a plurality of arms 24*b*, 25*b* and 26*b* of which 25*b* and 26*b* are shown in FIG. 5. The arms extend radially outwardly between the hub 16*b* and the rotating cylinder 14*b*.

The method also includes supporting the syphon such that the syphon extends through the bore 22*b* for permitting rotation of the hub 16*b* relative to the syphon 12*b* and piloting a centering gauge 101 disposed on the inside end of syphon 12 as shown, or on the bore 22*b* of the hub 16*b*, not shown. The centering gauge 101 has a measurement arm 102 that extends radially towards an internal surface 32*b* of the rotating cylinder 14*b*.

Additionally, the method includes adjusting a relative length of the arms 24*b*-26*b* respectively for positioning the hub 16*b* within the cylinder 14*b* and using the measurement arm 102 to guide the positioning of the hub 16*b* so that the hub 16*b* is positioned coaxially relative a rotational axis 40*b* of the rotating cylinder 14*b* so that the stationary syphon is supported by the hub 16*b* which is disposed coaxially within the rotating cylinder 14*b*.

The arms 24*b*, 25*b* and 26*b* are attached to the hub 16*b* and will rotate with the cylinder 14*b*. Inside the bore of the hub 16*b*, there are 1, 2 or 3 cylindrical carbon graphite bushings (sleeve bearings). Two of these bushings 104 and 105 are shown in FIG. 5. The syphon 12 (not shown in its entirety in FIG. 5) extends from the inside surface of the rotating cylinder, through the hub 16*b*, through the supporting bushings, and out through the cylinder journal 103. The syphon 12 remains stationary while the hub 16*b* rotates around it, with the bushings 104 and 105 providing the bearing support.

A cylindrical recess in the centering gauge 101 matches the cylindrical extension of the flanged end of the horizontal portion of the syphon 12. Centering gauge 101 can be slipped over the cylindrical extension of syphon 12 so that the two cylindrical portions are coaxial. The centering gauge 101 can then be rotated around the cylindrical extension of syphon 12 while all the time maintaining a common axis of rotation. The arms 24*b*-26*b* are then adjusted so that the gap between the end of the measurement arm 102 and the internal surface 32*b* remains uniform. This results in the axis of the horizontal portion of the syphon being coaxial with the rotational axis 40*b* of the rotating cylinder 14*b* (which is also the rotational axis of the internal surface 32*b*. As an alternative, the centering gauge could be piloted in the bore 22*b* of the hub 16*b*.

In operation of the apparatus 10 according to the present invention, the support apparatus is positioned within the rotating cylinder 14. The compression spring 80 urges the foot 76 of the arm 24 against the internal surface 32 of the rotating cylinder 14 as shown in FIG. 3. Additionally, the spring 80 by reaction with the threaded device 72 and the hub 16 will roughly center the hub 16 and attached syphon 12 within the rotating cylinder 14. The threading devices 72 on each of the arms 24-26 are then adjusted by rotation thereof so that the hub and syphon extending therethrough are accurately centered within the rotating cylinder. Such accurate adjustment is achieved by virtue of the present invention even if the internal surface 32 of the rotating cylinder has not been machined. In the case of older type rotating cylinders, sometimes the internal surface 32 has not been machined and the internal surface 32 thereof may be slightly eccentric or offset relative to the rotational axis 40 of the rotating cylinder 14. Nevertheless, according to the present invention, by the relative selective adjustment of the threaded devices 72 of the arms 24-26, the hub 16 is able to be accurately centered on the rotational axis of the rotating cylinder so that the stationary syphon 12 can be accurately spaced relative to the internal surface 32 of the rotating cylinder 14 for the removal therefrom of the condensate.

The present invention provides a unique arrangement for supporting a stationary syphon within a dryer shell even when the inside surface of the dryer head or journal has not been machined and where the inside diameter of the support journal of the dryer may be relatively small.

What we claim is:

1. A support apparatus for supporting a stationary syphon within a rotating cylinder, said support apparatus comprising:

a hub disposed within the rotating cylinder such that said hub rotates with the rotating cylinder, said rotatable hub having a first and a second end, said rotatable hub defining a bore;

said bore extending between said ends of said rotatable hub for the flow therethrough of condensate removed from within the rotating cylinder by the stationary syphon;

a first, second and third arm secured to and extending radially outwardly from said rotatable hub, each of said arms having an inner and an outer extremity;

said outer extremities of said arms being secured to an internal surface of the rotating cylinder such that said arms and said rotatable hub rotatably support the stationary syphon within the rotating cylinder.

2. A support apparatus for supporting a syphon as set forth in claim 1 wherein said hub is of cylindrical configuration, said hub having a first face disposed adjacent to said first end of said hub, a second face disposed adjacent to said second end of said hub and an external cylindrical surface which extends from said first to said second face.

3. A support apparatus for supporting a syphon as set forth in claim 2 wherein said first and said second face are disposed normal to an axis of rotation of said hub.

4. A support apparatus for supporting a syphon as set forth in claim 2 wherein said bore extends from said first to said second face.

5. A support apparatus for supporting a syphon as set forth in claim 1 wherein said bore is disposed coaxially within said hub.

6. A support apparatus for supporting a syphon as set forth in claim 4 further including:

a bearing disposed coaxially within said bore for bearingly supporting said hub relative to the syphon.

7. A support apparatus for supporting a syphon as set forth in claim 1 wherein each arm is circumferentially equidistantly spaced from an adjacent arm.

8. A support apparatus for supporting a syphon as set forth in claim 1 wherein each of said arms includes:

a first portion having an inner end and an outer end, said inner ends of said first portions of said arms being secured to said hub;

a second portion having an inner termination and an outer termination, said inner terminations of said second portions of said arms being secured to said outer ends of said first portions of said arms;

said outer terminations of said second portions of said arms being secured to the internal surface of the rotating cylinder.

9. A support apparatus for supporting a syphon as set forth in claim 8 wherein each of said outer ends of said first portions defining a flange;

each of said inner terminations of said second portions of said arms defining a further flange such that said further flange and said flange of each arm cooperate with each other for permitting the releasable fastening of said first and second portions to each other.

10. A support apparatus for supporting a syphon as set forth in claim 8 wherein each of said second portions includes:

a first tube having a first and a second side;

a second tube having an inner and an outer side, said second tube slidably cooperating with said first tube;

a threaded device for selectively adjusting an axial disposition of said tubes of said second portion relative to each other such that said arms and said hub disposed therebetween support the syphon relative to the internal surface of the rotating cylinder during rotation of the rotating cylinder around the syphon.

11. A support apparatus for supporting a syphon as set forth in claim 10 wherein said first tube slides telescopically within said second tube.

12. A support apparatus for supporting a syphon as set forth in claim 11 wherein said second side of said first tube defines an external thread which cooperates with said threaded device such that when said threaded device threadably engages said external thread of said first tube, said threaded device urges said inner side of said second tube axially relative to said first tube and radially relative to said hub for urging said outer side of said second tube against the internal surface of the rotating cylinder.

13. A support apparatus for supporting a syphon as set forth in claim 12 further including:

a foot disposed between said outer side of said second tube and the internal surface of the rotating cylinder such that said arms are firmly supported within the rotating cylinder for supporting said hub so that the syphon is supported stationary relative to the rotating cylinder.

14. A support apparatus for supporting a syphon as set forth in claim 13 further including:

a biasing device extending between said threaded device and said foot for evenly urging said foot into engagement with the internal surface of the rotating cylinder.

15. A support apparatus for supporting a syphon as set forth in claim 14 wherein said biasing device is a compression spring having an inner and an outer termination, said inner termination of said spring being biased against said threaded device and said outer termination of said spring being biased against said foot.

16. A method of installing in a rotating cylinder the apparatus as set forth in claim 1, said method comprising the steps of:

directing a laser beam through a journal bore of the rotating cylinder along the rotating cylinder roll axis and through the hub bore of the hub; and adjusting the length of each radial arm extending radially from the hub using the laser beam as a guide so that the hub bore is positioned concentrically on the roll axis, for permitting location of rotating cylinder such that said arms are firmly supported within the rotating cylinder for supporting said hub so that the syphon is supported stationary relative to the rotating cylinder.

17. A method for installing a stationary syphon within the apparatus set forth in claim 1, the method comprising the steps of:

centering a gauge slipped over a cylindrical extension of a stationary syphon so that the two cylindrical portions are coaxial;

rotating the centering gauge around the cylindrical extension of the syphon while all the time maintaining a common axis of rotation; and adjusting each arm so that a gap between an end of a measurement arm and an internal surface of a rotating cylinder remains uniform such that an axis of a horizontal portion of the syphon is coaxial with a rotational axis of the rotating cylinder which is also the rotational axis of the internal surface.

* * * * *

UNITED STATES PATENT AND TRADEMARK OFFICE

CERTIFICATE OF CORRECTION

PATENT NO. : 8,826,560 B2
APPLICATION NO. : 11/514691
DATED : September 9, 2014
INVENTOR(S) : Beach et al.

It is certified that error appears in the above-identified patent and that said Letters Patent is hereby corrected as shown below:

In the Specification

Column 1, line 61, "enter" should read --center--

Signed and Sealed this
Eighteenth Day of November, 2014

Michelle K. Lee

Michelle K. Lee
*Deputy Director of the United States Patent and Trademark Office*